US006999032B2

(12) United States Patent
Pakray et al.

(10) Patent No.: US 6,999,032 B2
(45) Date of Patent: Feb. 14, 2006

(54) ANTENNA SYSTEM EMPLOYING FLOATING GROUND PLANE

(75) Inventors: Ahmad B. Pakray, Rochester Hills, MI (US); Kenneth P. Lee, Bingham Farms, MI (US); Imtiaz Zafar, Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 61 days.

(21) Appl. No.: 10/252,332

(22) Filed: Sep. 23, 2002

(65) Prior Publication Data

US 2004/0056811 A1 Mar. 25, 2004

(51) Int. Cl.
*H01Q 1/32* (2006.01)

(52) U.S. Cl. ..... 343/713; 343/700 MS; 343/712

(58) Field of Classification Search ..... 343/713, 343/700 MS, 712, 715, 829, 830
See application file for complete search history.

(56) References Cited

U.S. PATENT DOCUMENTS 5,539,418 A * 7/1996 Egashira et al. ..... 343/712
5,565,877 A * 10/1996 Du et al. ..... 343/715
6,163,303 A 12/2000 Nagy ..... 343/713
6,323,810 B1 * 11/2001 Poilasne et al. ..... 343/700 MS

* cited by examiner

*Primary Examiner*—James Vannucci
(74) *Attorney, Agent, or Firm*—Stefan V. Chmielewski

(57) ABSTRACT

An antenna system is assembled to a dielectric medium on a vehicle and is spaced from an electrically conductive member so as to allow for enhanced antenna performance. The dielectric medium has first and second surfaces and a dielectric thickness between the first and second surfaces. An antenna is mounted to the first surface of the dielectric medium for receiving and/or transmitting signals. An electrically conductive member is mounted to the second surface of the dielectric medium for providing a floating ground that forms a capacitive coupling with the antenna. The electrically conductive member is dielectrically isolated from vehicle electrical ground.

19 Claims, 1 Drawing Sheet

ANTENNA SYSTEM EMPLOYING FLOATING GROUND PLANE

TECHNICAL FIELD

The present invention generally relates to antennas and, more particularly, to a mounted antenna system employing a ground plane, particularly for use on a vehicle.

BACKGROUND OF THE INVENTION

Automotive vehicles are increasingly being equipped with electronic devices such as radios, global positioning system (GPS) receivers, cell phones, and other infotainment, entertainment and telematics devices that require wireless data communication. Each wireless communication device typically employs an antenna to receive and/or transmit signals to communicate with remote transmitting and/or receiving devices. For example Satellite Digital Audio Radio System (SDARS) antennas communicate radio frequency (RF) signals with one or more satellites. The SDARS antennas are generally required to be positioned in a substantially unobstructed view of one or more satellites to communicate signals therebetween.

In conventional vehicle mounted antenna applications, antennas are typically mounted on vehicle housings, such as the roof panel or the rear decklid, or on one of the windows. Currently, most automotive vehicle housings generally include metallic (electrically conductive) body panels. On metallic vehicle housings, the antenna is typically mounted outside of a metallic body panel to prevent signal blocking interference from the electrically conductive body panels. In vehicles employing a metallic housing, the metallic housing generally serves as an electrical ground which provides some antenna radiation pattern stability to the wireless signal communication. However, many vehicle body housings are made of a composite dielectric (i.e., electrically non-conductive) material, such as fiberglass. In the past, vehicle mounted antennas have been mounted to a composite dielectric member of the housing (body) of the vehicle. However, the antenna mount arrangement on vehicles having composite body members generally has not optimized the wireless signal communication.

It is therefore desirable to provide for an antenna mount arrangement on a vehicle which optimizes the antenna radiation pattern to enhance antenna performance. In particular, it is desirable to provide for an antenna mounted on a vehicle having a dielectric composite housing to enhance the antenna signal performance.

SUMMARY OF THE INVENTION

The present invention provides for an antenna system mounted on an electrically non-conductive dielectric member in a manner to allow for enhanced antenna performance. The antenna system includes a dielectric medium having first and second surfaces and a dielectric thickness between the first and second surfaces. An antenna is mounted to the first surface of the dielectric medium for performing at least one of receiving and transmitting signals. An electrically conductive member is mounted to the second surface of the dielectric medium for forming a capacitive coupling with the antenna. The electrically conductive member is dielectrically isolated from electrical ground. Accordingly, the antenna system of the present invention refines the signal radiation pattern, provides stable impedance, achieves high gain values and low ripple (i.e., maximum/minimum signal ratio), and thus stabilizes the antenna radiation pattern and enhances signal performance.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
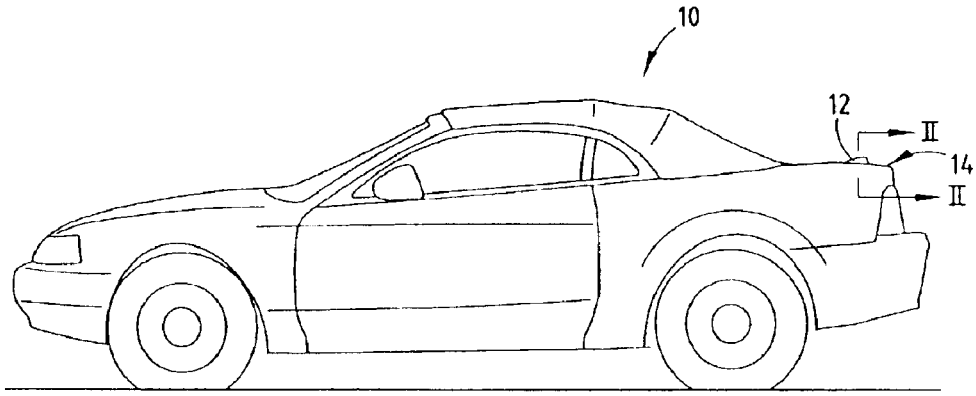
FIG. 1 is a perspective view of a vehicle having an antenna mounted to a dielectric decklid body panel.

Referring to FIG. 1, an automotive vehicle 10 is generally illustrated having an antenna 12 mounted on top of a rear decklid body panel 14. The vehicle 10 has an outer housing (body) that is generally made up of one or more body panels. At least one body panel (e.g., decklid) 14 is made of an electrically non-conductive (i.e., dielectric) material such as a dielectric composite material. For example, the rear decklid body panel 14 may be composed of fiberglass or other electrically non-conductive composite materials. The antenna 12 is mounted to one of the dielectric body panels, such as rear decklid 14, as shown. However, it should be appreciated that antenna 12 can be mounted on other dielectric body panels at other locations on the vehicle, including the roof, the front hood, and other members which present a suitable mounting arrangement for an antenna to communicate with a remote signal transmitter and/or receiver.

The antenna 12 is positioned to communicate with a remote transmitter and/or receiver, such as one or more satellites or ground-based antennas, via wireless signal communication. In order to optimize the reception and/or transmission of a clear signal, the antenna 12 is positioned on the vehicle 10 in view of the communicating satellite(s) or ground-based antenna, so as to prevent interference from other obstructions on the vehicle. Antenna 12 may include any of a number of powered and unpowered antennas employable on a vehicle. For example, antenna 12 may include a Satellite Digital Audio Radio System (SDARS) antenna for communicating with one or more satellites. Another example of antenna 12 may include a global positioning system (GPS) antenna for receiving signals transmit from multiple satellites to acquire global position information. A further example of antenna 12 may include a cell phone antenna for transmitting and receiving signals to and from ground-based and/or satellite antennas. The antenna 12 may also include combinations of multiple antennas including SDARS, GPS, cell phone, and audio radio antennas.

Figure 2:
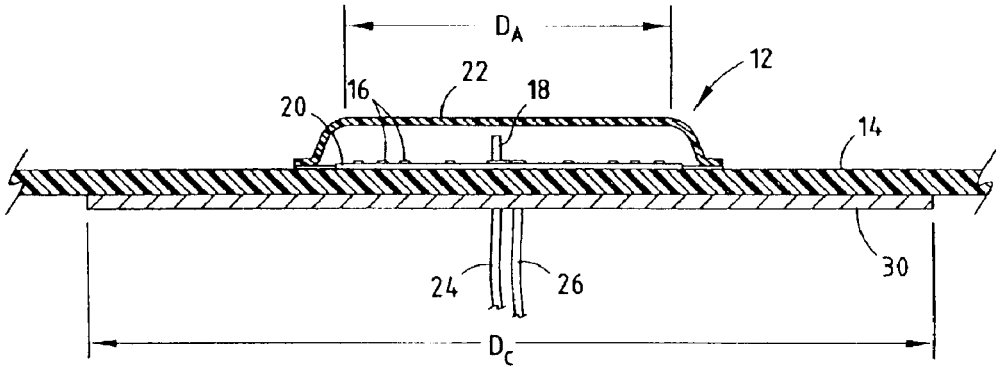
FIG. 2 is a cross-sectional view taken through lines II—II of FIG. 1 showing the antenna mount arrangement.

The arrangement of the antenna 12 mounted to the dielectric decklid body panel 14 of the vehicle 10 is further illustrated in FIG. 2. The antenna 12, according to the embodiment shown, includes the combination of a patch antenna having a printed circuit (patch) 16 formed on a substrate 20 and a short (e.g., 20 mm) monopole antenna 18 extending vertical relative to the horizontal patch antenna. The antenna 12 has an effective length dimension $D_A$ of about 94 mm and a width of about 81 mm, according to one example. The antenna 12 includes a signal transmissive protective cover 22 extending over the patch antenna 16 and monopole antenna 18 elements. While a combination patch and monopole antenna 12 is shown and described herein according to one embodiment, it should be appreciated that antenna 12 may include other powered and unpowered antennas including, but not limited to, an individual patch antenna, an individual monopole antenna, or a helicoil antenna, according to other embodiments.

The antenna 12 is mounted to a first (upper) surface of the dielectric medium 14 such that the antenna is unobstructively visible to one or more remote communication devices. The antenna 12 may be mounted to dielectric medium 14 via any of a number of known attachment techniques including the use of fasteners and/or adhesives. The dielectric medium 14 is in the form of a vehicle body member, such as the rear decklid of the vehicle 10, and includes a dielectric thickness of less than 6 mm, and more preferably has a dielectric thickness in the range of 2 to 5 mm.

The dielectric medium 14 has a second (lower) surface, provided on the bottom side. An electrically conductive member 30 is mounted to the lower second surface of the dielectric medium 14. The arrangement of the electrically conductive member 30 below antenna 12 and separated via dielectric medium 14 provides for the formation of a capacitive coupling between the electrically conductive member 30 and the antenna 12. The electrically conductive member 30 is not electrically connected to an electrical ground. Instead, electrically conductive member 30 is dielectrically isolated from the vehicle electrical ground and, thus, acts as a floating ground. This is in contrast to a metallic vehicle body panel having a much greater surface area which acts as the vehicle electrical ground.

Figure 3:
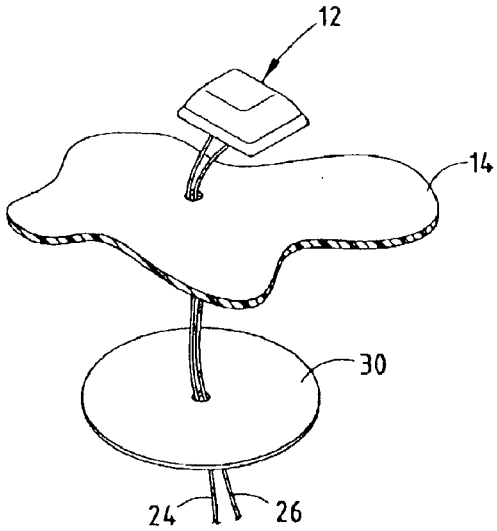
FIG. 3 is an exploded view of the antenna system shown in FIG. 1.

The electrically conductive member 30 is positioned directly below the antenna 12 and may be configured in various shapes, such as a circular shape as shown in FIG. 3 or a rectangular shape (not shown). The electrically conductive member 30 has a dimension, such as a diameter Dc, of at least 130 mm for a circular conductive member. For a rectangular electrically conductive member 30, at least one of the length and width has a dimension Dc of at least 130 mm. The antenna 12 interfaces with the first surface of the dielectric medium 14 within a first surface area of the dielectric medium 14 defined by the adjoining surfaces. The electrically conductive member 30 has a second surface area interfacing with the second surface of the dielectric medium 14 as defined by the adjoining surfaces. The second surface area of the electrically conductive member 30 is at least as large as the first surface area of the antenna 12.

By providing a capacitive coupling between antenna 12 and electrically conductive member 30, the floating ground plane provided by electrically conductive member 30 results in a stable impedance, improves the average gain values, improves the average values for terrestrial and satellite antenna elements, and enhances minimum gain values. In addition, the ripple (maximum/minimum signal ratio) is also lowered as a result of this antenna mount arrangement. Consequently, the signal performance of the antenna 12 is dramatically improved by providing the capacitive coupling to the floating ground plane.

As is seen in FIG. 3, the antenna 12 includes a first coaxial cable 24 and a second coaxial cable 26. The first and second coaxial cables 24 and 26 provide RF signal lines, a voltage input line, and a ground line. The RF signal lines communicate RF signals between the antenna elements and processing circuitry (not shown). While two antenna elements 16 and 18 are shown, it should be appreciated that a single antenna element may be employed to receive all desired signals (e.g., terrestrial and satellite). It should also be appreciated that the antenna 12 may be used for receiving signals from one or more remote transmitters and/or transmitting signals to one or more remote receivers, as should be evident to those skilled in the art.

Accordingly, the antenna mount arrangement of the present invention advantageously provides for an antenna mounted to a dielectric body panel 14 of a vehicle 10 in a manner to provide enhanced antenna signal performance. While the antenna 12 is shown mounted to a decklid 14 of a vehicle 10, it should be appreciated that the antenna 12 may be mounted to other dielectric members of the vehicle 10 according to the mount arrangement of the present invention.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An antenna system comprising:

a dielectric medium having first and second surfaces and a dielectric thickness between the first and second surfaces;

an antenna mounted to the first surface of the dielectric medium for performing at least one of receiving and transmitting signals; and an electrically conductive member mounted to the second surface of the dielectric medium and dielectrically isolated from the antenna for forming a capacitive coupling with the antenna, wherein the electrically conductive member is dielectrically isolated from electrical ground and acts as a floating ground.

2. The antenna system as defined in claim 1, wherein the electrically conductive member has a second surface area interfacing with the second surface of the dielectric medium that is at least as large as a first surface area of the antenna interfacing with the first surface of the dielectric medium.

3. The antenna system as defined in claim 1, wherein the electrically conductive member has a length dimension of at least 130 mm.

4. The antenna system as defined in claim 1, wherein the dielectric medium has a thickness of less than 6 mm.

5. The antenna system as defined in claim 4, wherein the dielectric medium has a thickness in the range of 2 to 5 mm.

6. The antenna system as defined in claim 1, wherein the dielectric medium comprises a composite material.

7. The antenna system as defined in claim 6, wherein the composite material comprises fiberglass.

8. The antenna system as defined in claim 1, wherein the antenna system is mounted on a vehicle, wherein the dielectric medium comprises a body panel of the vehicle.

9. The antenna system as defined in claim 1, wherein the antenna comprises a satellite antenna for communicating satellite signals.

10. A vehicle mounted antenna system comprising;

a dielectric medium fixed to a vehicle and having first and second surfaces and a dielectric thickness between the first and second surfaces;

an antenna mounted to the first surface of the dielectric medium for performing at least one of receiving and transmitting signals; and an electrically conductive member mounted to the second surface of the dielectric medium and dielectrically isolated from the antenna for forming a capacitive coupling with the antenna, wherein the electrically conductive member is dielectrically isolated from electrical ground of the vehicle and acts as a floating ground.

11. The antenna system as defined in claim 10, wherein the electrically conductive member has a length dimension of at least 130 mm.

12. The antenna system as defined in claim 10, wherein the dielectric medium has a thickness of less than 6 mm.

13. The antenna system as defined in claim 12, wherein the dielectric medium has a thickness in the range of 2 to 5 mm.

14. The antenna system as defined in claim 10, wherein the dielectric medium comprises a composite material.

15. The antenna system as defined in claim 14, wherein the composite material comprises fiberglass.

16. The antenna system as defined in claim 10, wherein the antenna comprises a satellite antenna for communicating satellite signals.

17. The antenna system as defined in claim 10, wherein the electrically conductive member has a second surface area interfacing with the second surface of the dielectric medium that is at least as large as a first surface area of the antenna interfacing with the first surface of the dielectric medium.

18. The antenna system as defined in claim 10, wherein the dielectric medium comprises a body panel of the vehicle.

19. The antenna system as defined in claim 18, wherein the body panel comprises a rear decklid of the vehicle.

* * * * *